US005103793A

United States Patent [19]

Riese et al.

[11] Patent Number: 5,103,793

[45] Date of Patent: Apr. 14, 1992

[54] VAPOR SEPARATOR FOR AN INTERNAL COMBUSTION ENGINE

[75] Inventors: Stephen B. Riese, Oshkosh; James Hubbell, Fond du Lac, both of Wis.

[73] Assignee: Brunswick Corporation, Skokie, Ill.

[21] Appl. No.: 641,523

[22] Filed: Jan. 15, 1991

[51] Int. Cl.[5] ..... F04B 39/16

[52] U.S. Cl. ..... 123/516; 123/509; 123/510

[58] Field of Search ..... 123/509, 510, 512, 514, 123/516; 417/360; 210/188, 416.4, 16.7, 416.1; 55/88, 165

[56] References Cited

U.S. PATENT DOCUMENTS

| | | | |
|---|---|---|---|
| 1,189,096 | 6/1916 | Gizunwald | 123/514 |
| 2,419,146 | 4/1947 | Kimm et al. | 210/416.4 |
| 4,372,847 | 2/1983 | Lewis | 123/510 |
| 4,500,425 | 2/1985 | Thornton | 210/416.4 |
| 4,546,750 | 10/1985 | Brunell et al. | 123/514 |
| 4,672,937 | 6/1987 | Fales et al. | 123/509 |
| 4,722,708 | 2/1988 | Baltz | 123/514 |
| 4,763,684 | 8/1988 | Kelch | 123/514 |
| 4,799,940 | 1/1989 | Millikan | 55/165 |
| 4,844,043 | 7/1989 | Keller | 123/516 |
| 4,844,704 | 7/1989 | Jiro | 123/509 |
| 4,848,283 | 7/1989 | Garms et al. | 123/73 AD |
| 4,860,713 | 8/1989 | Hodgkins | 123/514 |
| 4,869,225 | 9/1989 | Nagata et al. | 123/509 |
| 4,878,518 | 11/1989 | Tuckey | 123/510 |
| 4,878,816 | 11/1989 | Tuckey | 123/510 |
| 4,893,647 | 1/1990 | Tuckey | 123/514 |
| 4,928,657 | 5/1990 | Asselin | 123/509 |
| 4,989,572 | 2/1991 | Giacomazzi et al. | 123/510 |

*Primary Examiner*—E. Rollins Cross
*Assistant Examiner*—Thomas N. Moulis
*Attorney, Agent, or Firm*—Andrus, Sceales, Starke & Sawall

[57] ABSTRACT

A vapor separator assembly for an internal combustion engine includes a bowl member and a cover member. A fuel pump is located in the internal cavity of the bowl member and has its inlet located in the lower portion of the bowl member cavity, for supplying fuel thereto. The fuel pump is secured in position within the bowl member by engagement of the cover member with the fuel pump. The cover member includes a mounting portion for mounting a water separating filter element to the vapor separator assembly. The cover member includes structure for routing fuel from the discharge of the water separating filter element to the interior of the bowl member internal cavity. A compact arrangement is thus provided for the vapor separator, the fuel pump and the water separating filter, eliminating a number of hose connections between such components as well as facilitating assembly to the engine.

31 Claims, 3 Drawing Sheets

VAPOR SEPARATOR FOR AN INTERNAL COMBUSTION ENGINE

BACKGROUND AND SUMMARY

This invention relates to the fuel system of an internal combustion engine, and more particularly to a vapor separator for use in an engine fuel system.

In a fuel injected engine, it is common to employ a vapor separator to separate light vapors from the fuel before injecting the fuel into the engine. This prevents the vapors from being included with the injected fuel, which otherwise would result in the engine running at a leaner than optimum air-fuel ratio. A vapor separator typically entails an enclosed reservoir in which a predetermined level of fuel is maintained, with the fuel vapors being vented from the upper portion of the reservoir. Fuel is discharged from the vapor separator through an opening formed in a bottom wall of the reservoir, and is supplied to a high-pressure fuel pump for pumping the fuel to the fuel injectors. In addition, in a marine application of an internal combustion engine, it is common to employ a water separating filter upstream of the vapor separator for eliminating water from the fuel. A low-pressure pump, operating from pressure generated within the engine crankcase, supplies fuel from the fuel tank to the water separating filter, whereafter the fuel flows to the vapor separator and to the high-pressure pump.

In the past, the above-mentioned components have been separately mounted to the engine in various locations and removed from each other. This entails connecting hoses between the outlet of the low-pressure pump and the inlet of the water separating filter, as well as between the water separating filter outlet and the vapor separator inlet; the vapor separator outlet and the high pressure pump inlet; and the high pressure pump outlet and the fuel injectors. Accordingly, many separate parts must be produced, and each assembled to the engine and the hose connections made between the parts.

The present invention has as its object to provide a compact package for the various elements disposed between the low pressure pump and the fuel injectors. Yet another object of the invention is to reduce the number of parts which must be assembled to the engine, and accordingly the number of steps involved in assembling the parts to the engine.

In accordance with the invention, a vapor separator for the fuel system of an internal combustion engine comprises an enclosed fuel reservoir, formed of a bowl member and a cover member for enclosing the open top of the bowl member. A reservoir inlet is interconnected with the engine fuel system for providing fuel to the reservoir. A fuel pump is disposed within the reservoir, and has an inlet located toward the lower portion of the reservoir for supplying fuel to the fuel pump from the reservoir. The fuel pump has an outlet for discharging fuel therefrom to the fuel injectors. The cover member preferably includes an opening through which the upper end of the fuel pump projects, and sealing structure is provided for enclosing the reservoir about the fuel pump. A vent is provided in the cover member for venting vapors from the fuel contained within the bowl member. The inlet to the reservoir is preferably provided in the cover member. A mounting plate is provided within the reservoir for supporting and mounting the lower end of the fuel pump within the reservoir.

The outer edge of the mounting plate engages a lip formed on an inner wall of the bowl member, to provide support for the lower end of the fuel pump. With the inlet of the fuel pump being located in the interior of the bowl member, the hose connection between the fuel pump and the vapor separator is eliminated. In addition, a compact arrangement is provided for mounting the fuel pump to the engine through the vapor separator.

The invention further contemplates a method of constructing a vapor separator, substantially in accordance with the foregoing summary.

In accordance with another aspect of the invention, a water separating filter mounting portion is provided on the cover member, and is adapted to receive a water separating filter such that the filter is located exteriorly of the walls of the bowl member. The mounting portion includes an inlet for supplying fuel to the inlet of the filter, and an outlet for receiving fuel from the filter outlet. A passage is formed in the cover member, extending between and communicating with the mounting portion outlet and the reservoir inlet, for supplying fuel to the reservoir from the mounting portion outlet. With this arrangement, the hose connection between the outlet of the water separating filter and the inlet of the vapor separator is eliminated, and a compact arrangement is provided for mounting of the water separating filter to the engine through the vapor separator.

The invention further contemplates a method of assembling a vapor separator, substantially in accordance with the above summary.

In a particularly preferred form of the invention, the aspects of the invention summarized above are together incorporated into a vapor separator, thus substantially reducing the number of hose connections and greatly facilitating assembly of the various components to the engine.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
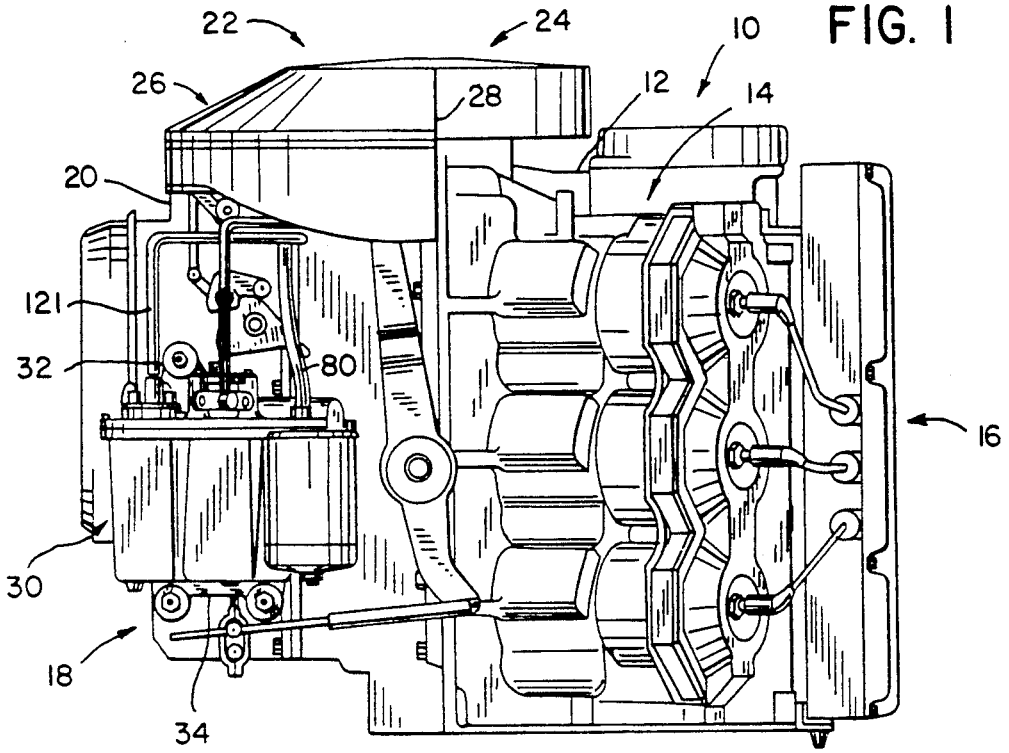
FIG. 1 is a side elevation view of a two-stroke cycle vertical axis V-6 internal combustion engine incorporating the vapor separator of the invention.

FIG. 1 illustrates a two-stroke cycle V-6 internal combustion engine 10 associated with the power head of an outboard marine propulsion unit. Engine 10 includes an engine block 12 which defines a pair of vertical cylinder banks oriented at an angle relative to each other, to provide a conventional V-shaped engine configuration. One of the cylinder banks is illustrated generally at 14, and includes three horizontally oriented cylinders. The opposite cylinder bank is similarly constructed, thereby forming a V-6 engine. An electrical housing 16 is mounted to engine block 12 between the cylinder banks, and houses the electrical componentry associated with engine 10 in a single location. An air manifold 18 is mounted to a rearwardly facing mounting surface provided on engine block 12. The upper surface of air manifold 18 is provided with an upstanding cylindrical portion 20, which provides an upwardly facing opening for supplying intake air into an internal cavity provided in the interior of air manifold 18. A one-piece assembly 22 is connected to the upper end of engine block 12, and includes a flywheel cover portion 24 and an air intake portion 26. Flywheel cover portion 24 encloses a flywheel mounted to the upper end of a crankshaft rotatably supported within a crankcase formed in the interior of engine block 12, as is known. Air intake portion 26 defines a air flow path for supplying intake air to cylindrical portion 20 of air manifold 18 through an air intake opening 28.

One-piece assembly 22 is described in detail in co-pending application Ser. No. 07/641,660 filed on even date herewith. Air manifold 18 is described in detail in co-pending application Ser. No. 07/641,522 filed on even date herewith. The disclosures of the noted co-pending applications are hereby incorporated by reference.

A vapor separator assembly 30 is mounted to the side of air manifold 18. Vapor separator assembly 30 includes an upper mounting bracket 32 and a lower mounting bracket 34. Bolts extend through openings formed in brackets 32 and 34 and into threaded openings formed in lugs provided on the side of air manifold 18, for mounting vapor separator assembly 30 to air manifold 18.

Figure 2:
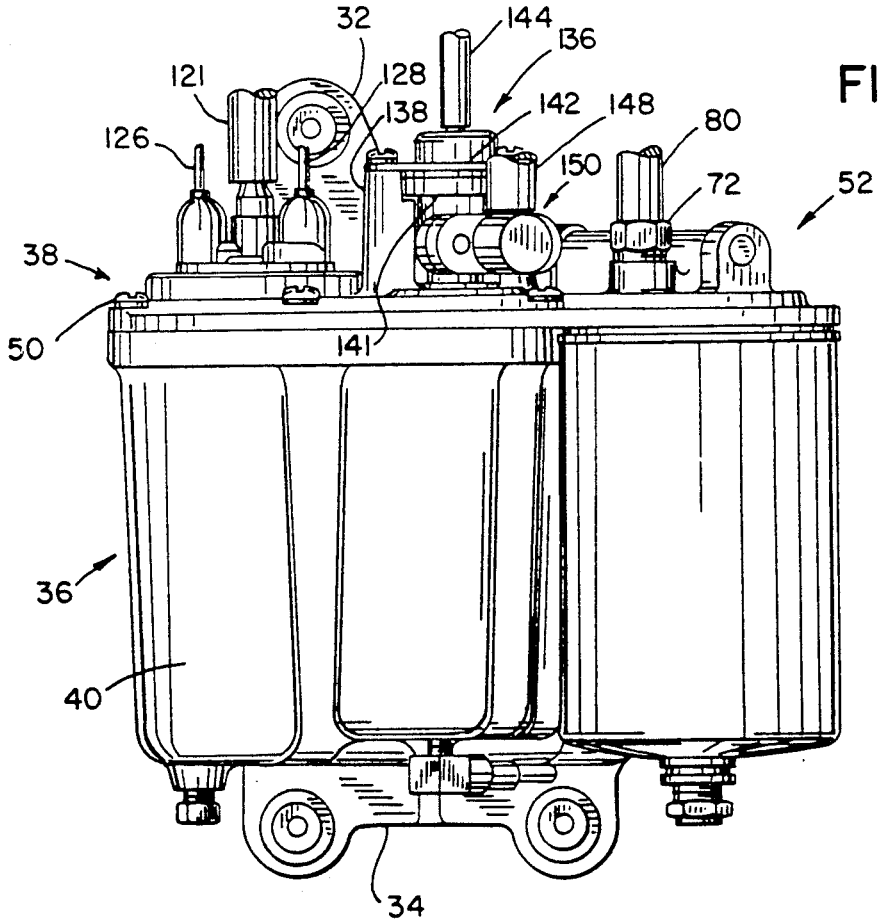
FIG. 2 is a side elevation view of the vapor separator of the invention.
Figure 3:
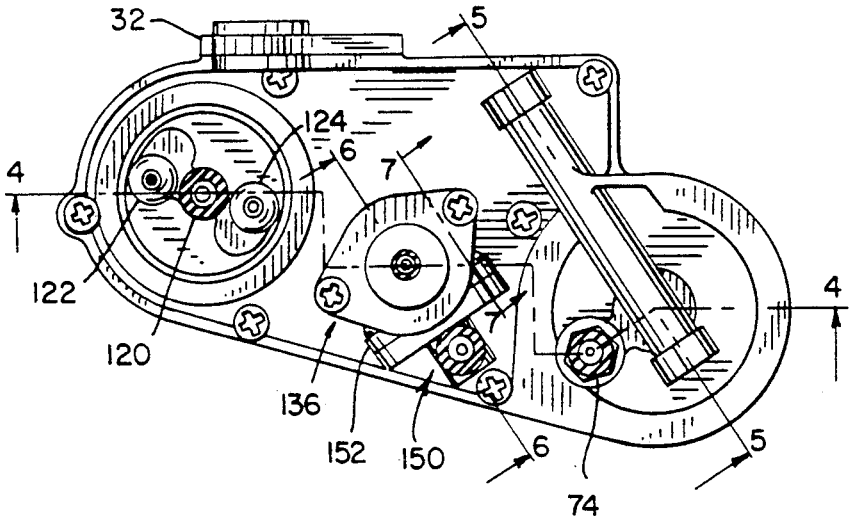
FIG. 3 is a top plan view of the vapor separator of FIG. 2.
Figure 4:
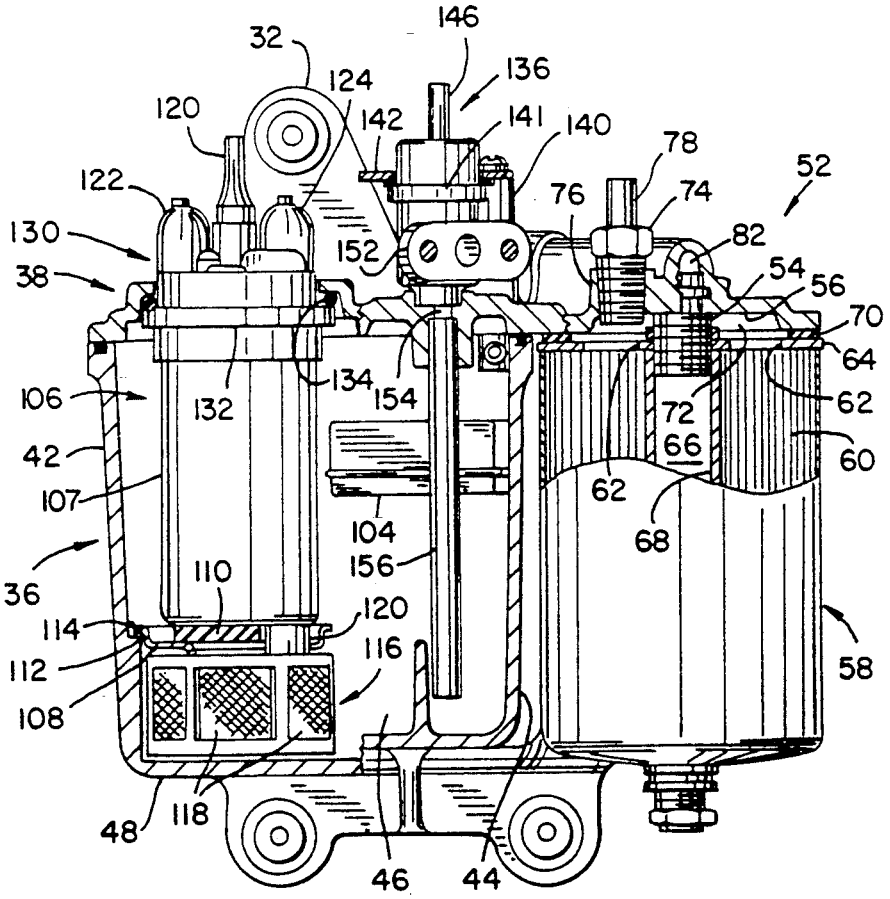
FIG. 4 is a vertical section view of the vapor separator of FIG. 2, taken along line 4—4 of FIG. 3.

Referring to FIGS. 1, 2 and 4 vapor separator assembly 30 broadly comprises a bowl member 36 and a cover member 38. Bowl member 36 includes a front wall 40, a pair of side walls 42 and 44 (FIG. 4), a rear wall 46 (FIG. 4) and a bottom wall 48 (FIG. 4). Walls 40–48 cooperate to define a reservoir or internal cavity to bowl member 36, having an open upper end. Cover member 38 is connected to the upper ends of walls 40–46 by screws 50 extending through the edges of cover member 38 and into threaded openings formed in the upper ends of walls 40–46.

Referring to FIGS. 2 and 4, a filter mounting portion 52 is formed integrally with cover member 38 and extends rightwardly of wall 44 of bowl member 36. A nipple 54 (FIG. 4) is connected to mounting portion 52 and includes a threaded portion depending below a raised lower surface 56 of mounting portion 52. Nipple 54 includes an axial passage extending throughout its length.

A water separating filter element 58 is connected to the threaded portion of nipple 54. Water separating filter element 58 is of conventional construction, including pleated filter media 60 and a membrane for separating water out of fuel circulated therethrough. A series of inlet openings 62 are formed in a mounting plate 64 provided at the upper end of filter element 58, and a central discharge passage 66 receives the filtered fuel. Passage 66 is defined by a tubular wall 68 which is threaded at its upper end to receive the external threads provided on nipple 54. To provide a fluid-tight seal, a gasket 70 is sandwiched between the upper surface of mounting plate 64 and the facing undersurface of mounting portion 52.

Raised lower surface 56 of mounting portion 52 defines an annular inlet passage 72. A threaded fuel inlet nipple 74 is mounted within an internally threaded boss 76 formed on mounting portion 52. Nipple 74 includes an axial passage therethrough, and is provided with an upstanding tubular portion 78 to which a fuel inlet hose 80 (FIG. 2) is connected. Inlet hose 80 supplies fuel from the low pressure pump (not shown) to filter inlet passage 72 through nipple 74, whereafter the fuel circulates through water separating filter element 58 and is discharged upwardly through passage 66 and out through the upper end of filter mounting nipple 54.

Figure 5:
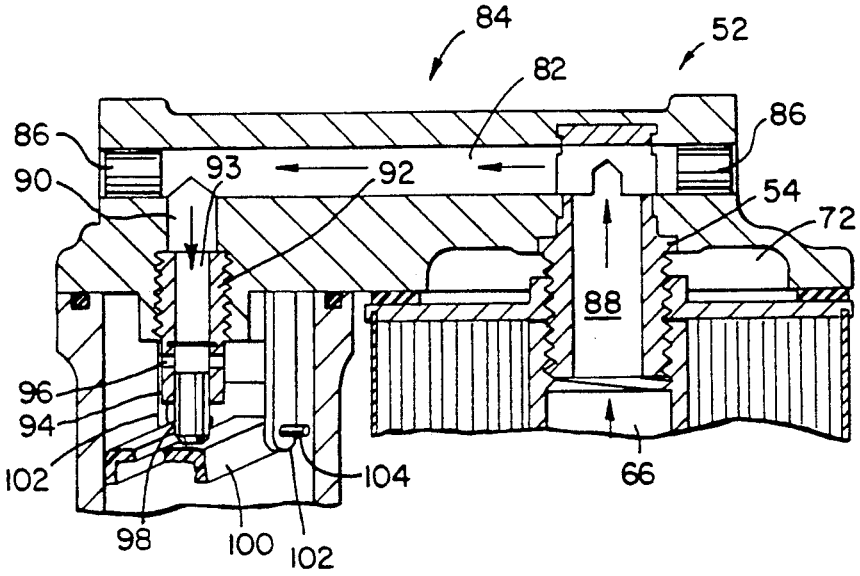
FIG. 5 is a partial sectional view taken along line 5—5 of FIG. 3.
Figure 6:
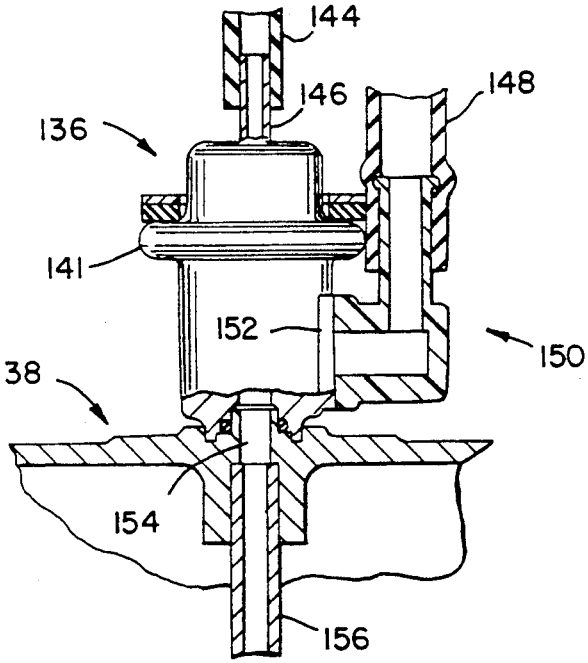
FIG. 6 is a partial sectional view taken along line 6—6 of FIG. 3.

Referring to FIGS. 4 and 5, the passage through filter mounting nipple 54 opens into a horizontal transfer passage 82 formed in a raised portion 84 associated with filter mounting portion 52 of cover member 38. A pair of threaded plugs 86 are mounted in the internally threaded ends of passage 82 for sealing its ends. After discharge from the axial passage, shown at 88, formed in filter mounting nipple 54, the fuel passes in the direction of the arrows through transfer passage 82 and downwardly into a vertical passage 90 provided in mounting portion 52.

A threaded nipple 92 is mounted to cover member mounting portion 52, and includes a vertical passage 93 communicating with mounting portion passage 90. Nipple 92 further includes a cylindrical discharge portion 94 which extends downwardly from the underside of cover member mounting portion 52, and a series of discharge orifices 96 are formed in the side walls of discharge portion 94 for discharging fuel from nipple passage 93.

A needle member 98 is slidably movable within nipple passage 93, and is secured to an arm 100. Arm 100 is pivotably mounted at its outer end to a pair of depending bracket members 102 by means of a pin 104, and is connected at its inner end to a float member 104 (FIG. 4), which is located within the internal cavity of bowl member 36.

Float member 104 tacts to provide a predetermined level of fuel within the internal cavity of bowl member 36. Float member 104 is biased downwardly by gravity, and rises along with the level of fuel supplied to the interior of bowl member 36, so as to raise arm 100 as the level of fuel rises. When arm 100 is raised an amount sufficient to raise needle member 98 to block passages 96 in discharge portion 94, the supply of fuel to the interior of bowl member 36 is cut off. When the level of fuel within bowl member 36 is lowered, needle member 98 is moved downwardly within passage 93 so as to open discharge orifices 96, thereby again supplying fuel to the interior of bowl member 36.

A fuel pump 106 (FIG. 4) having a pump body 107 is located in the internal cavity of bowl member 36. Fuel pump 106 is an immersion type fuel pump, and is supported at its lower end by a plate member 108 which engages a bottom cover 110 provided on fuel pump 106. Plate member 108 includes a lip 112 formed about its outer periphery, which engages an upwardly facing shoulder 114 formed in bowl member walls 40, 42 and 46. With this arrangement, plate member 108 supports fuel pump 106 thereabove.

A fuel filter element 116 is disposed within the internal cavity of bowl member 36 below plate member 108, and includes a fine mesh screen 118 through which fuel passes into an internal fuel intake cavity. An upwardly extending nipple 120 is provided on fuel filter element 116, and is mounted to a depending projection provided on fuel pump 106 for mounting fuel filter element 116 to fuel pump 106. A slot is formed in plate member 108 for accommodating passage of fuel filter element nipple 120 therethrough.

With the arrangement as shown and described, filtered fuel is supplied to fuel pump body 107 from the lowermost portion of the internal cavity of bowl member 36.

Fuel pump 106 functions in a conventional manner to supply fuel under pressure to a fuel outlet nipple 120, which is adapted for connection to an outlet hose 122 (FIG. 2) for supplying fuel to the fuel injectors in a conventional manner. A pair of terminals 122, 124 (FIG. 4) are provided on fuel pump 106 for supplying electrical power to the fuel pump motor (not shown) through wires 126, 128 (FIG. 2), in a manner as is known.

Fuel pump outlet nipple 120 and terminals 122, 124 are provided on a cap member 130 mounted to the upper end of fuel pump body 107. Cap member 130 further includes an outwardly projecting flange 132 located below the portion of cap member 130 which extends through an opening formed in cover member 38, for mounting the upper end of fuel pump 106 to cover member 38. An O-ring 134 is placed between the upper surface of flange 132 and the underside of cover member 38 adjacent the openings therethrough, to provide a fluid-tight seal at the opening in cover member 38. In addition, this arrangement secures the upper end of fuel pump 106 in position.

With the arrangement as shown and described, fuel is drawn directly into the inlet of fuel pump 106 from the interior of bowl member 36, and hose connections to the inlet of fuel pump 106 are eliminated. Accordingly, fuel under pressure is discharged directly from bowl member 36 to the fuel injectors.

Referring to FIGS. 2 and 4, a pressure regulating valve 136 is mounted to a pair of upstanding posts 138 (FIG. 2) and 140 (FIG. 4) provided on cover member 38. Posts 138, 140 provide facing shoulders which engage the underside of a flange 141 formed on pressure regulating valve 136, and a bracket member 142 extends between and is connected to the upper ends of posts 138, 140 for securing pressure regulating valve 136 in position on cover member 38.

Pressure regulating valve !36 is a conventional diaphragm-type valve as is used in fuel injection systems, such as is available from the Keihin Company.

Reference air pressure is supplied to pressure regulating valve 136 from an air hose 144 which communicates air pressure from the interior of air manifold 18 to an inlet tubular projection 146 (FIG. 4) associated with pressure regulating valve 136. A fuel return hose 148 provides return flow of fuel from the fuel injectors to a fuel return fitting 150, which is connected to a mounting plate !52 provided on pressure regulating valve 136. In accordance with known construction and operation, pressure regulating valve 136 acts to ensure that fuel is supplied to the fuel injectors under a predetermined pressure relative to the pressure in air manifold 18, with the return flow of fuel discharged from fuel return fitting 150 being controlled by reference air pressure from air manifold 18 through air hose 144.

The fuel discharge outlet of pressure regulating valve 136 is located over a discharge opening 154 formed in cover member 38, and a fuel return tube 156 extends below cover member 38 downwardly into the internal cavity of bowl member 36. With this arrangement, fuel returned through return fitting 150 and discharged through the outlet of pressure regulating valve 136 is supplied to the lower portion of the internal cavity of bowl member 3 through return tube 156.

Figure 7:
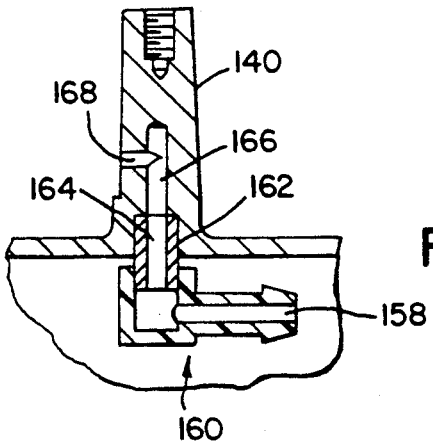
FIG. 7 is a partial sectional view taken along line 7—7 of FIG. 3.

Referring to FIGS. 4 and 7, the light vapors which are separated from fuel contained within the internal cavity of bowl member 36 pass through a horizontal passage 158 provided in a fitting 160, which is connected to the depending portion of a nipple 160 mounted to the underside of cover member 38. The vapors pass from horizontal passage 158 through fitting 160 to a nipple passage 164 and to a vertical drilled passage 166 formed in post 140. Thereafter, the vapors are vented through a horizontal passage 168 to the interior of the cowl assembly which houses engine 10, and are supplied along with the intake air to air manifold 18 for ultimate combustion in the air-fuel mixture.

Various alternatives and embodiments are contemplated as being within the scope of the following claims particularly pointing out and distinctly claiming the subject matter regarded as the invention.

We claim:

1. A vapor separator for the fuel system of an internal combustion engine, comprising:

an enclosed fuel reservoir comprising a bowl member having an open top, and a cover member for enclosing the open top of the bowl member;

a reservoir inlet interconnected with the engine fuel system for providing fuel to the reservoir;

a fuel pump disposed within the reservoir, the fuel pump having an inlet located toward the lower portion of the reservoir for providing fuel to the fuel pump from the reservoir, and an outlet for discharging fuel therefrom; and means associated with the reservoir for accommodating discharge of fuel therefrom through the fuel pump outlet to the engine fuel system.

2. The vapor separator of claim 1, wherein the cover member includes vent means for venting vapors from fuel within the bowl member.

3. The vapor separator of claim 1, wherein the reservoir inlet is provided in the cover member.

4. The vapor separator of claim 3, wherein the cover member includes a filter mounting portion adapted to mount a water separating filter thereto such that the filter is located exteriorly of the bowl member.

5. The vapor separator of claim 4, wherein the filter mounting portion of the cover member includes a fuel inlet for supplying fuel to the inlet of the filter, and a fuel outlet for receiving fuel from the filter outlet.

6. The vapor separator of claim 5, further comprising a passage provided in the cover member for conveying fuel from the fuel outlet to the reservoir inlet.

7. The vapor separator of claim 5, wherein the cover member and the filter mounting portion are integrally formed.

8. The vapor separator of claim 1, wherein the fuel pump inlet is located at the lower end of the fuel pump and the fuel pump outlet is located at the upper end of the fuel pump, and wherein the means for accommodating discharge of fuel from the reservoir comprises an opening formed in the cover member for receiving and mounting the upper end of the fuel pump below the fuel pump outlet.

9. The vapor separator of claim 8, further comprising fuel pump mounting structure extending into the interior of the bowl member for supporting and mounting the lower end of the fuel pump within the reservoir.

10. The vapor separator of claim 9, wherein the fuel pump mounting structure comprises a plate member engaging the fuel pump lower end and being supported at its outer edge by a lip formed on an inner wall of the bowl member.

11. The vapor separator of claim 9, wherein the fuel pump includes a mounting flange located toward its upper end and located below the opening formed in the cover member, wherein the upper surface of the mounting flange engages the lower surface of the cover member adjacent the opening therein.

12. A vapor separator for the fuel system of an internal combustion engine, comprising:

an enclosed fuel reservoir;

a reservoir inlet interconnected with the engine fuel system for providing fuel to the reservoir;

a fuel pump disposed within the reservoir, the fuel pump having an inlet located toward the lower portion of the reservoir for providing fuel to the fuel pump from the reservoir, and an outlet for discharging fuel therefrom;

a fuel filter element disposed within the reservoir upstream of the fuel pump inlet for filtering fuel supplied to the fuel pump inlet; and means associated with the reservoir for accommodating discharge of fuel therefrom through the fuel pump outlet to the engine fuel system.

13. The vapor separator of claim 12,, further comprising a support plate located within the reservoir for supporting the lower end of the fuel pump, and wherein the fuel filter element depends from the fuel pump below the support plate.

14. A method of constructing a vapor separator, comprising the steps of:

providing a bowl member having an open upper end and one or more walls defining an internal cavity adapted to receive fuel therein;

positioning a fuel pump having an inlet and an outlet within the internal cavity of the bowl member such that the inlet of the fuel pump is located toward the lower portion of the internal cavity and the outlet of the fuel pump is located above the open upper end of the bowl member; and securing a cover member to the bowl member to enclose the open upper end of the bowl member, with the cover member including an opening for receiving the upper end of the fuel pump below the fuel pump discharge outlet.

15. The method of claim 14, further comprising the step of connecting a fuel filter element to the fuel pump upstream of the fuel pump inlet within the internal cavity of the bowl member.

16. The method of claim 14, further comprising the step of connecting a water separating filter member to a portion of the cover member externally of the walls of the bowl member.

17. The method of claim 16, further comprising the step of forming a passage in the cover member for communicating between the outlet of the water separating filter member and an inlet formed in the cover member, through which fuel is introduced into the interior cavity of the bowl member.

18. A vapor separator for the fuel system of an internal combustion engine, comprising:

structure defining an enclosed vapor separator fuel reservoir;

a reservoir inlet interconnected with the engine fuel system for providing fuel to the reservoir;

a reservoir outlet interconnected with the engine fuel system for providing fuel from the reservoir to the engine fuel system;

a vent located toward the upper portion of the reservoir communicating between the interior and the exterior of the reservoir for venting fuel vapors present within the upper portion of the reservoir;

a water separating filter mounting portion associated with the structure defining the enclosed reservoir and being adapted to mount a water separating filter element thereto, the mounting portion including an inlet located upstream of the reservoir inlet for supplying fuel to the filter element, and an outlet for receiving fuel discharged from the filter element; and conduit means extending between the mounting portion outlet and the reservoir inlet for supplying fuel to the reservoir inlet from the mounting portion outlet.

19. The vapor separator of claim 19, wherein the structure defining the enclosed fuel reservoir comprises a bowl member having an internal cavity defined by a plurality of walls and having an open top, and a cover member positioned over the open top of the bowl member.

20. The vapor separator of claim 19, wherein the filter mounting portion is connected to the cover member and wherein the filter member is connected to the mounting portion so as to be located exteriorly of the walls of the bowl member.

21. The vapor separator of claim 20, wherein the filter mounting portion comprises an extension formed integrally with the cover member and projecting outwardly from the walls of the bowl member.

22. The vapor separator of claim 21, wherein the reservoir inlet is formed in the cover member, and wherein the conduit means comprises a passage formed in the cover member, the passage extending between and being in communication with the reservoir inlet and the mounting portion outlet.

23. The vapor separator of claim 18, further comprising a fuel pump disposed within the reservoir, the fuel pump having an inlet for supplying fuel thereto from the lower portion of the reservoir, and a discharge outlet interconnected with the engine fuel system.

24. A vapor separator for the fuel system of an internal combustion engine, comprising:

structure defining an enclosed fuel reservoir, comprising a bowl member having an internal cavity defined by a plurality of walls and having an open top, and a cover member positioned over the open top of the bowl member;

a reservoir inlet interconnected with the engine fuel system for providing fuel to the reservoir;

a reservoir outlet interconnected with the engine fuel system for providing fuel from the reservoir to the engine fuel system;

a water separating filter mounting portion associated with the structure defining the enclosed reservoir and being adapted to mount a water separating filter element thereto, the mounting portion including an inlet for supplying fuel to the filter element and an outlet for receiving fuel discharged from the filter element;

conduit means extending between the mounting portion outlet and the reservoir inlet for supplying fuel to the reservoir inlet from the mounting portion outlet; and a fuel pump disposed within the internal cavity of the bowl member, the fuel pump having an inlet for supplying fuel thereto from the lower portion of the internal cavity, and a discharge outlet interconnected with the engine fuel system.

25. The vapor separator of claim 24, further comprising a fuel filter element located upstream of the fuel pump inlet and located in the lower portion of the internal cavity, for filtering fuel prior to its passage into the fuel pump inlet.

26. A method of assembling a vapor separator, comprising the steps of:

providing a bowl member having an open top and an internal cavity defined by a plurality of walls;

mounting a cover member to the bowl member to enclose the open top thereof, the bowl member and cover member cooperating to define an internal cavity;

providing a vent for venting vapors from the upper portion of the internal cavity;

providing an inlet for allowing passage of fuel into the bowl member internal cavity;

mounting a water separating filter element to the cover member such that the filter element is located exteriorly of the bowl member internal cavity, the filter element having an inlet and an outlet; and interconnecting the filter element outlet with the bowl member inlet so that fuel is supplied to the inlet of the bowl member internal cavity from the fuel element outlet.

27. The method of claim 26, wherein the step of providing a bowl member inlet comprises forming an inlet in the cover member.

28. A method of assembling a vapor separator, comprising the steps of:

providing a bowl member having an open top and an internal cavity defined by a plurality of walls;

mounting a cover member to the bowl member to enclose the open top thereof;

providing an inlet for allowing passage of fuel into the bowl member internal cavity by forming an inlet in the cover member;

mounting a water separating filter element to the cover member such that the filter element is located exteriorly of the bowl member internal cavity, the filter element having an inlet and an outlet, wherein the filter element is mounted to the cover member such that its outlet is located adjacent the cover member; and interconnecting the filter element outlet with the bowl member inlet for supplying fuel to the bowl member internal cavity from the fuel element outlet by forming a passage in the cover member communicating with and extending between the bowl member and the filter element outlet.

29. A vapor separator for the fuel system of an internal combustion engine, comprising:

a bowl member having an open top and an internal cavity defined by a plurality of walls;

a fuel pump disposed within the internal cavity of the bowl member and including an inlet for receiving fuel from the lower portion of the internal cavity and an outlet for discharging fuel therefrom;

a cover member mounted to the bowl member for enclosing the internal cavity thereof and for securing the fuel pump in position within the internal cavity of the bowl member, the cover member including a fuel inlet for passing fuel into the bowl member internal cavity;

a mounting portion provided on the cover member for mounting a water separating filter element to the vapor separator exteriorly of the bowl member internal cavity, the mounting portion including an inlet for passing fuel into the water separating filter element and an outlet for receiving fuel from the water separating filter element; and a passage formed in the cover member and extending between the cover member fuel inlet and the mounting portion outlet for supplying fuel to the bowl member fuel inlet from the outlet of the water separating filter element.

30. A fuel system for an internal combustion engine, in which fuel is supplied from a fuel tank, comprising:

a fuel supply line in which fuel is supplied by a low pressure pump from the tank;

a vapor separator reservoir separate from the fuel tank for receiving fuel from the supply line;

a fuel pump disposed within the reservoir, the fuel pump having an inlet located toward the lower portion of the reservoir for providing fuel to the fuel pump from the reservoir, and an outlet for discharging fuel therefrom;

means associated with the reservoir for accommodating discharge of fuel therefrom through the fuel pump outlet; and a fuel discharge line connected to the fuel pump outlet for providing fuel to the engine from the fuel pump.

31. The fuel system of claim 30, further comprising a fuel pressure regulator and a line disposed between the pressure regulator and the vapor separator reservoir for supplying return flow of fuel thereto from the pressure regulator.

* * * * *

UNITED STATES PATENT AND TRADEMARK OFFICE

CERTIFICATE OF CORRECTION

PATENT NO. : 5,103,793

DATED : April 14, 1992

INVENTOR(S) : STEPHEN B. RIESE ET AL

It is certified that error appears in the above-identified patent and that said Letters Patent is hereby corrected as shown below:

Claim 19, Col. 8, Line 24, delete "19" (second occurrence) and substitute therefor -- 18 --.

Signed and Sealed this

Thirteenth Day of July, 1993

*Attest:*

Michael K. Kirk

MICHAEL K. KIRK

*Attesting Officer*

*Acting Commissioner of Patents and Trademarks*